US007256753B2

(12) United States Patent
Werner et al.

(10) Patent No.: US 7,256,753 B2
(45) Date of Patent: Aug. 14, 2007

(54) SYNTHESIS OF METAMATERIAL FERRITES FOR RF APPLICATIONS USING ELECTROMAGNETIC BANDGAP STRUCTURES

(75) Inventors: Douglas H. Werner, State College, PA (US); Douglas J. Kern, Northampton, PA (US)

(73) Assignee: The Penn State Research Foundation, University Park, PA (US)

( * ) Notice: Subject to any disclaimer, the term of this patent is extended or adjusted under 35 U.S.C. 154(b) by 676 days.

(21) Appl. No.: 10/755,539

(22) Filed: Jan. 12, 2004

(65) Prior Publication Data

US 2004/0140945 A1 Jul. 22, 2004

Related U.S. Application Data

(60) Provisional application No. 60/440,118, filed on Jan. 14, 2003.

(51) Int. Cl.
*H01Q 15/02* (2006.01)

(52) U.S. Cl. ..... 343/909; 343/756

(58) Field of Classification Search ..... 343/756, 343/700 MS, 909, 911 R
See application file for complete search history.

(56) References Cited

U.S. PATENT DOCUMENTS

| | | | | |
|---|---|---|---|---|
| 5,657,024 | A | 8/1997 | Shingyoji et al. | 342/175 |
| 5,719,794 | A | 2/1998 | Altshuler et al. | 364/578 |
| 5,872,534 | A | 2/1999 | Mayer | 342/1 |
| 5,917,458 | A * | 6/1999 | Ho et al. | 343/909 |
| 6,061,025 | A | 5/2000 | Jackson et al. | 343/700 |
| 6,147,572 | A | 11/2000 | Kaminski et al. | 333/134 |
| 6,198,438 | B1 | 3/2001 | Herd et al. | 343/700 |
| 6,218,978 | B1 | 4/2001 | Simpkin et al. | 342/5 |
| 6,262,495 | B1 | 7/2001 | Yablonovitch et al. | 307/101 |
| 6,411,261 | B1 | 6/2002 | Lilly | 343/756 |
| 6,483,481 | B1 | 11/2002 | Sievenpiper et al. | 343/909 |
| 6,498,369 | B1 | 12/2002 | Yamazaki et al. | 257/347 |
| 6,512,494 | B1 * | 1/2003 | Diaz et al. | 343/909 |
| 6,597,318 | B1 | 7/2003 | Parsche et al. | 343/700 |
| 6,608,607 | B2 * | 8/2003 | Wu | 343/909 |
| 6,661,392 | B2 | 12/2003 | Isaacs et al. | 343/911 |
| 6,906,674 | B2 * | 6/2005 | McKinzie et al. | 343/767 |
| 2003/0034918 | A1 | 2/2003 | Werner et al. | 343/700 |
| 2003/0076276 | A1 * | 4/2003 | Church et al. | 343/909 |
| 2003/0142036 | A1 * | 7/2003 | Wilhelm et al. | 343/909 |
| 2003/0223721 | A1 | 12/2003 | Povinelli et al. | 385/129 |

OTHER PUBLICATIONS

Werner, D., Kern, D., Pingjuan, L., Wilhelm, M., Monorchio, A., and Lanuzza, L., "Advances In the Design Synthesis of Electromagnetic Bandgap Metamaterials", date is not available.

(Continued)

*Primary Examiner*—Tan Ho
(74) *Attorney, Agent, or Firm*—Gifford, Krass, Sprinkle, Anderson & Citkowski, PC

(57) ABSTRACT

By configuring a high impedance frequency selective surface (HZ-FSS) structure for the appropriate values of surface impedance (surface resistance and surface reactance), a high frequency artificial ferrite metamaterial can be synthesized with almost any desired value of real and imaginary permeability. Materials with these properties have not previously been physically realizable at frequencies above 1 GHz.

20 Claims, 4 Drawing Sheets

OTHER PUBLICATIONS

Kern, D. and Werner, D., "A Genetic Algorithm Apporach to the Design of Ultra-Thin Electromagnetic Bandgap Absorbers", Microwave and Optical Technology Letters, Vo. 38, No. 1, Jul. 5, 2003, pp. 61-64.

Li, C. and Shen, Z., "Electromagnetic Scattering by a Conductin Cylinder Coated with Metamaterials", Progress in Electromagnetics Research, PIER 42, pp. 91-105,2003.

Remski, R., Gray, B., and Ma, L., "Frequency Selective Surfaces", Ansoft Corporation, Presentation #4, date is not available.

Kern, D., Werner, D., Wilhelm, M., and Church, K., "Genetically Engineered Multiband High-Impedance Frequency Selective Surfaces", Microwave and Optical Technology Letters, Vo. 38, No. 5, Sep. 5, 2003, pp. 400-403.

"Artificial Magnetic Conductor (AMC) Technology Information Bulletin", IS001-A-May 23, 2003, pp. 1-2.

* cited by examiner

SYNTHESIS OF METAMATERIAL FERRITES FOR RF APPLICATIONS USING ELECTROMAGNETIC BANDGAP STRUCTURES

REFERENCE TO RELATED APPLICATION

This application claims priority from U.S. Provisional Patent Application Ser. No. 60/440,118, filed Jan. 14, 2003, the entire content being incorporated herein by reference.

FIELD OF THE INVENTION

The present invention relates generally to metamaterial structures.

BACKGROUND OF THE INVENTION

Thin ferrite films have advantageous properties, such as absorption of electromagnetic radiation. However, it is well known that the properties of conventional ferrite materials are seriously degraded for frequencies above 1 GHz. There are numerous applications for materials or structures that provide the properties of a thin ferrite film at frequencies above those conventionally available.

Metamaterials are generally multi-component structures that can provide advantageous physical properties compared with uniform bulk materials. Such structures are also sometimes called engineered materials. A metamaterial ferrite is a metamaterial providing the properties of a ferrite film. It would also be very useful to be able to design metamaterials so as to provide desired permeabilities at given frequencies, particularly above 1 GHz.

A frequency selective surface (FSS) typically comprises a two-dimensional, doubly periodic, lattice-like structure of identical conducting elements. An FSS may also comprise an array of dielectric elements (possibly slots) within a conducting screen. A frequency selective surface (FSS) located close to a PEC (perfect electrical conductor) ground plane exhibits high impedance within narrow frequency bands, and is referred to as a high impedance frequency selective surface (HZ-FSS). Within these narrow frequency bands, the HZ-FSS structure functions as artificial magnetic conductor (AMC), having a reflection amplitude near unity and a surface reflection phase of zero degrees. An AMC can be used to suppress transverse electric and transverse magnetic surface waves. The term AMC is also used to refer to structures capable of acting as an artificial magnetic conductor at one or more frequencies.

FSS and AMC structures are described in U.S. Pat. No. 6,218,978 to Simpkin et al., U.S. Pat. No. 6,411,261 to Lilly, U.S. Pat. No. 6,483,481 to Sievenpiper et al., and U.S. Pat. No. 6,512,494 to Diaz et al.

FSS and AMC structures are of interest to antenna design. For example, U.S. Pat. No. 6,597,318 to Parsche et al. discloses a printed circuit antenna comprising a dielectric substrate disposed on a conductive ground plane. U.S. Pat. No. 6,262,495 to Yablonovitch et al. describes structures for eliminating surface currents on antenna surfaces. Also, U.S. Pat. No. 6,661,392 to Isaacs et al. discloses resonant antennas using metamaterials.

Patents and patent applications referenced in this disclosure are incorporated herein by reference.

SUMMARY OF THE INVENTION

This invention demonstrates that Electromagnetic Bandgap (EBG) structures may be interpreted as an equivalent PEC backed slab of magnetic material with a frequency dependent permeability. This property is exploited in order to develop a design methodology for realizing a metamaterial ferrite, or metaferrite.

A High-impedance Frequency Selective Surface (HZ-FSS) functioning as an Artificial Magnetic Conductor (AMC) is designed by optimizing for a desired surface resistance and reactance at the specified operating frequency or frequencies. These values of surface impedance are shown to be directly related to the real and imaginary parts of the effective permeability (i.e. magnetic permeability) of an equivalent magnetic material slab. Hence, the structure can be used to realize a metamaterial ferrite that retains its desirable magnetic properties at frequencies above 1 GHz.

By optimizing the surface impedance of the AMC, a metaferrite can be synthesized with nearly any desired real and imaginary values of permeability. This design procedure allows a low-loss negative permeability metaferrite to be realized, with potential application to the design of left-handed or double negative media.

Furthermore, the ability of the design procedure to optimize separately for the real and imaginary parts of the permeability allows for the synthesis of metaferrites with low-loss and either positive or negative values of $\mu$ at the desired frequency range of operation. This suggests that properly designed metaferrites may have application to the design of low loss left-handed or double-negative media by providing, in some applications, an alternative to split-ring resonators.

DETAILED DESCRIPTION OF THE INVENTION

Figure 1:
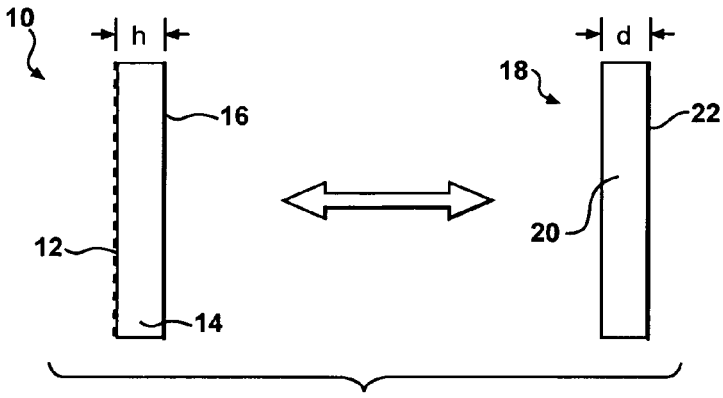
FIG. 1 illustrates the equivalence between HZ-FSS AMC structure with characteristic permittivity and magnetic (ferrite) material with PEC back plane and characteristic permeability.

FIG. 1 shows an artificial magnetic conductor (AMC) structure generally at 10, and a thin slab of PEC (perfect electrical conductor) backed magnetic material shown generally at 18. Using methods according to the present invention, a structure such as 10 can be designed so as to provide the desired permeability properties of a PEC-backed magnetic film such as 18. The equivalence between the structures 10 and 18 has not been previously appreciated in terms of the discussion below.

The AMC structure 10 comprises a frequency selective surface 12 printed on top of a thin dielectric substrate 14, the dielectric substrate having thickness h and dielectric constant $\epsilon$, and a PEC (perfect electrical conductor) backing 16. The surface impedance corresponding to the AMC structure is denoted by $$Z_{S1}=R_{S1}+jX_{S1} \tag{1}$$

The thin slab of PEC backed magnetic material, shown at 18, includes a ferrite material 20 with a PEC ground plane 22, the magnetic material having thickness d and permeability $\mu$. The surface impedance for the structure 18 can be expressed in the form $$Z_{S2}=Z \tanh(\gamma d) \tag{2}$$

where $$Z=\eta_0\sqrt{\mu_r} \tag{3}$$

$$\gamma=j\beta_0\sqrt{\mu_r} \tag{4}$$

Here, $\gamma$ is a propagation constant, $\beta_0$ is the wave number in free space, and $\eta_0$ is the characteristic impedance of free space. Equating the two expressions for surface impedance given in (1) and (2), gives the following characteristic equation:

$$R_{S1}+jX_{S1}=\eta_0\sqrt{\mu_r'-j\mu_r''}\tanh\left(j\beta_0 d\sqrt{\mu_r'-j\mu_r''}\right) \tag{5}$$

Using the small argument approximation for the hyperbolic tangent function (i.e., tan h(x)≈x) results in the following useful set of design equations:

$$\mu_r'=\frac{X_{S1}}{\eta_0\beta_0 d} \tag{6}$$

$$\mu_r''=\frac{R_{S1}}{\eta_0\beta_0 d} \tag{7}$$

These equations represent the effective permeability (real and imaginary parts) provided by the AMC structure 10 shown in FIG. 1. Hence, the AMC structure can act as a metaferrite slab providing these values of permeability.

These equations relate the surface resistance and surface reactance of an AMC structure such as 10 to the imaginary and real parts, respectively, of the metaferrite permeability. Furthermore, these design equations provide the basis for developing a synthesis approach for an AMC structure that exhibits a specified value of effective permeability at the desired frequency (or frequencies) of operation. The input parameters for this synthesis approach are the desired values of complex permeability, the specified value of operating frequency, and the desired effective thickness of the metaferrite material. The design parameters which can be optimized include the HZ-FSS unit cell size, screen geometry, thickness and complex permittivity of the dielectric substrate material, and the resistance of the HZ-FSS screen. Optimization is discussed in more detail below.

By optimizing a HZ-FSS AMC design for the appropriate values of $R_{S1}$ and $X_{S1}$, a high frequency artificial ferrite metamaterial can be synthesized with almost any desired value of real and imaginary permeability. Materials with these properties have not previously been physically realizable at frequencies above 1 GHz.

EXAMPLE

Figure 2A:
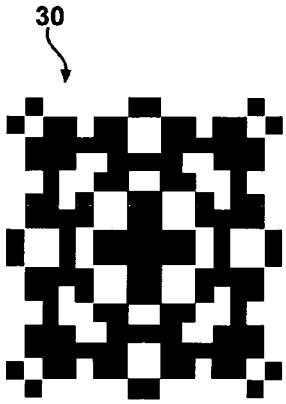
FIG. 2A shows the unit cell geometry of an HZ-FSS optimized for operation at 1.575 GHz.
Figure 2B:
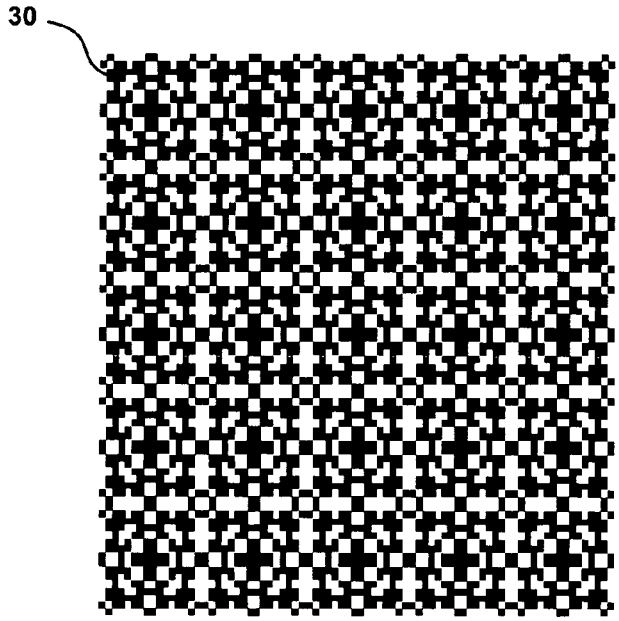
FIG. 2B shows the screen geometry of an HZ-FSS optimized for operation at 1.575 GHz.

Application of the above equations is illustrated using a HZ-FSS structure developed to have an AMC condition near 1.575 GHz. This structure has not been optimized for metaferrite use, but is discussed here as an illustrative example. FIGS. 2A and 2B show the HZ-FSS geometry. FIG. 2A shows the unit cell geometry, and FIG. 2B shows the screen geometry. The dielectric constant of the substrate material in this case was $\epsilon_r$=13−j0.025 with a thickness of 3.175 mm. The unit cell measures 1.849 cm by 1.849 cm.

Figure 3:
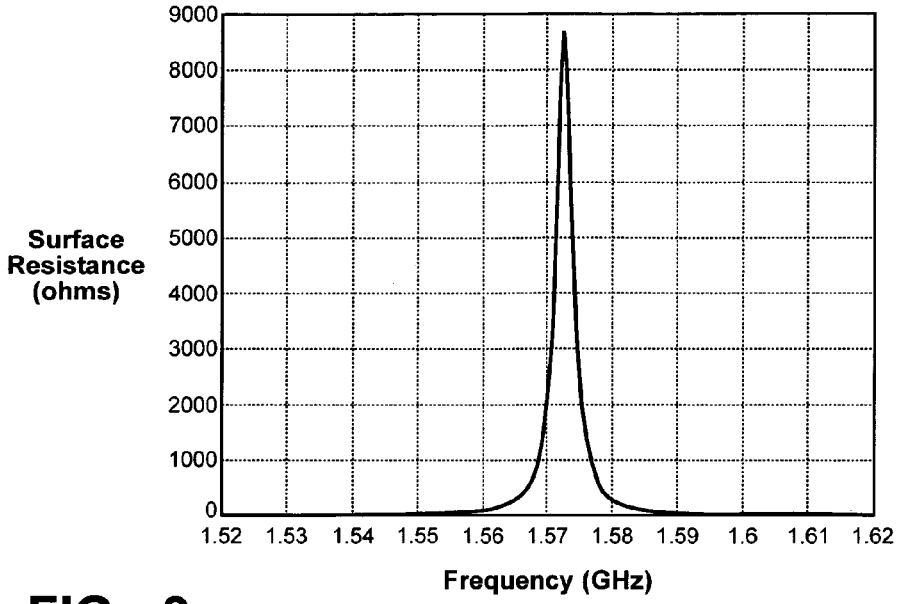
FIG. 3 shows the surface resistance of the HZ-FSS shown in FIG. 2.
Figure 4:
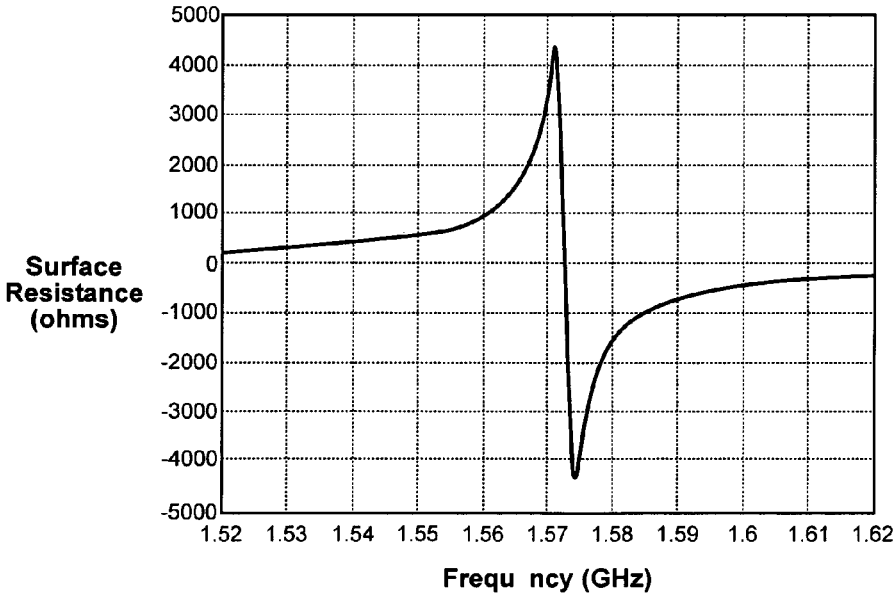
FIG. 4 shows the surface reactance of the HZ-FSS.

The surface impedance of such a structure can be routinely calculated using available software applications. FIGS. 3 and 4 illustrate the surface impedance near the resonant frequency of the structure shown in FIG. 2. FIG. 3 shows the surface resistance, and FIG. 4 shows the surface reactance.

The surface resistance and reactance data shown in FIGS. 3 and 4 may be used in conjunction with equations (6) and (7) to derive the characteristic curves for $\mu_r'$ and $\mu_r''$.

Figure 5:
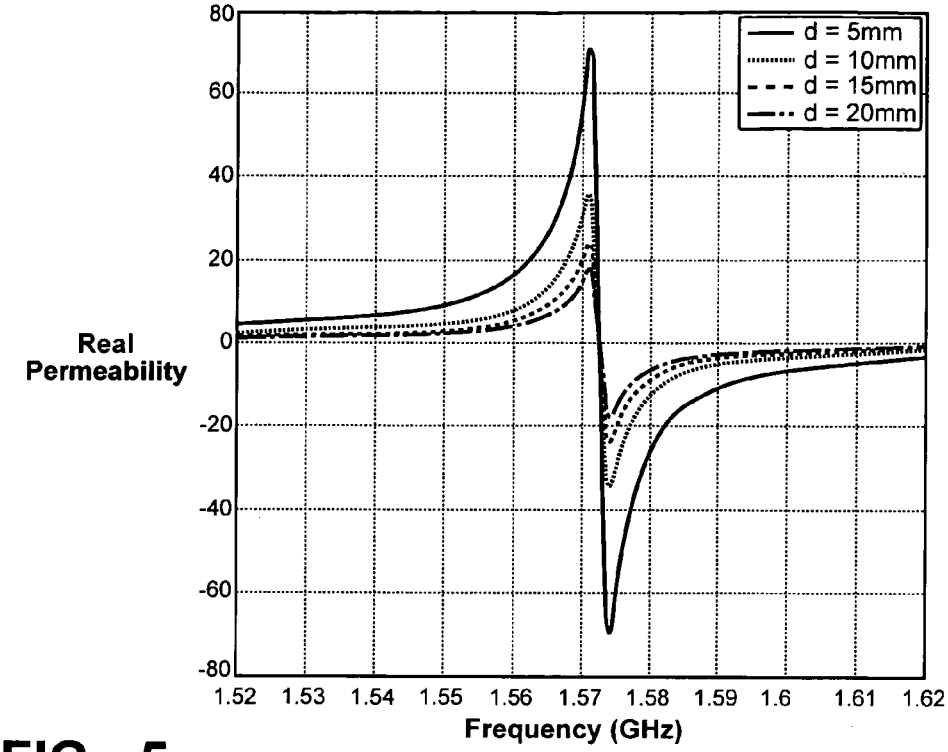
FIG. 5 shows the real part of permeability versus frequency for a metaferrite for different effective thicknesses.
Figure 6:
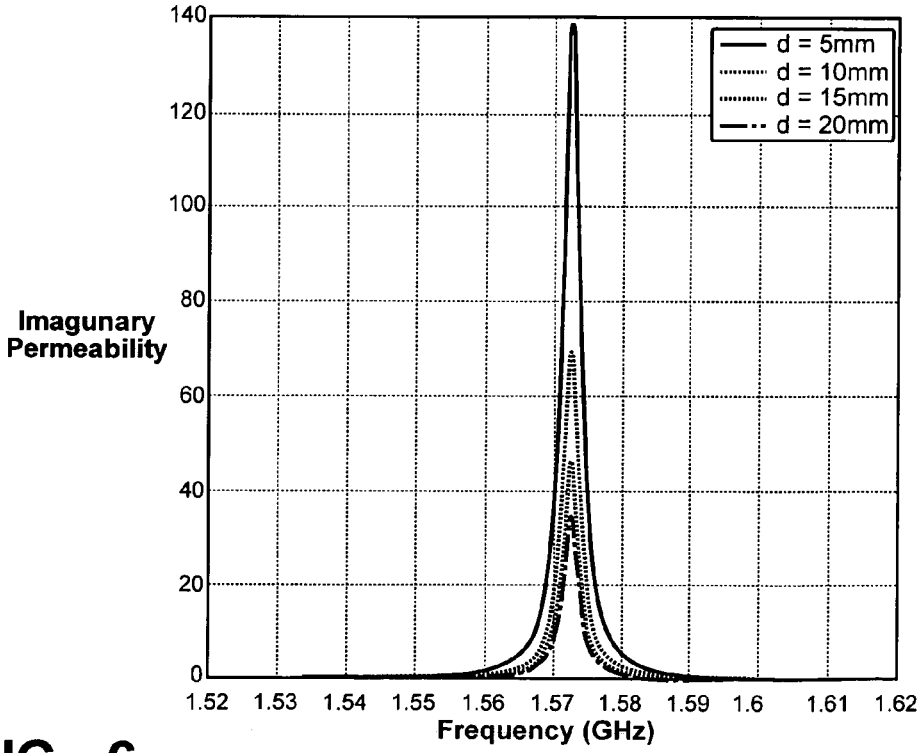
FIG. 6 shows the imaginary part of permeability versus frequency for a metaferrite for different effective thicknesses.

FIGS. 5 and 6 represent plots of the real and imaginary parts of the metaferrite permeability for values of effective thickness d between 5 and 20 mm. FIG. 5 shows the real part of the metaferrite permeability, and FIG. 6 shows the imaginary part of the metaferrite permeability. It is interesting to note that above 1.59 GHz the real part of the permeability is negative, while the imaginary part is relatively small. Hence, in this frequency range, the metaferrite is behaving as a low-loss negative $\mu$ material. Hence, such metaferrites may have application in the design of low-loss left-handed or double-negative media, discussed in more detail below.

The effective thickness d is the thickness of a hypothetical PEC-backed ferrite film having a similar permeability to the actual metamaterial structure. The metamaterial structure can allow for much thinner devices, as the dielectric thickness h is typically much less than the wavelength of electromagnetic radiation at the relevant frequency, for example less than one quarter of the wavelength.

Methods of Designing a Magnetic Metamaterial

In the example discussed above, permeability was calculated from surface impedance data for an existing AMC structure. For many applications, a specific permeability will be required at one or more given frequencies. Using the methods described here, the required permeability can be related to a required surface impedance at the same frequency for a frequency selective surface (FSS). An FSS can then be designed to provide the required value of surface impedance, consequently providing the required permeability.

Hence, a method of fabricating a magnetic metamaterial comprises: selecting desired real and/or imaginary values of permeability, selecting a desired value of operating frequency, selecting a desired metamaterial thickness, calculating desired values of surface impedance for a high-impedance frequency selective surface (HZ-FSS) using a characteristic design equation, and designing a high-impedance frequency selective surface or electromagnetic bandgap structure having required values of surface impedance at the desired operating frequency. An optimization technique can be used, as discussed below.

Optimization of Structures

Optimization methods include trial and error, genetic algorithms, particle swarm algorithms, and other methods known in the computational and mathematical arts.

The input parameters for an optimization technique can include the desired values of complex permeability, one or more specified values of operating frequency, and the desired effective thickness of the metaferrite material. Structural parameters which can be optimized include the FSS unit cell size, unit cell geometry, FSS screen geometry, dielectric parameters (thickness and complex permittivity), and the resistance of the FSS electrically conductive material.

Figure 7:
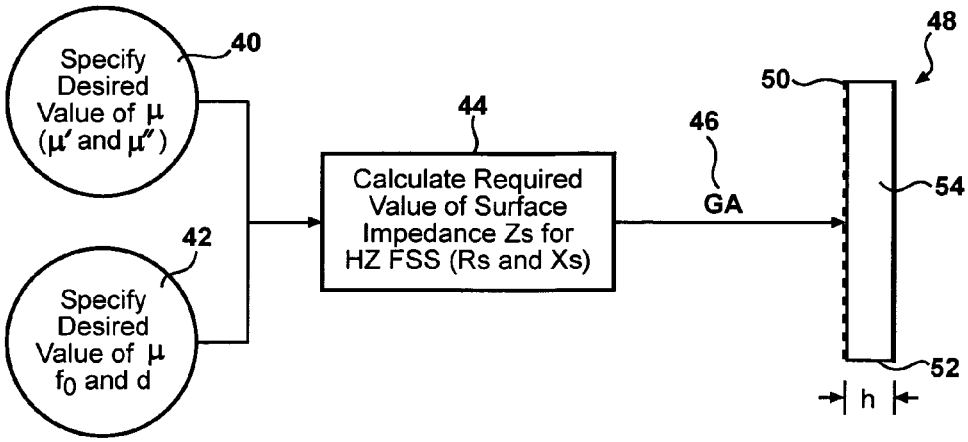
FIG. 7 shows a synthesis technique for a metaferrite using a genetic algorithm.

FIG. 7 illustrates a schematic of an optimization technique using a genetic algorithm. Circle 40 corresponds to the specification of a desired value of permeability (real and imaginary parts). Circle 42 corresponds to the specification of desired resonant frequency and thickness. Box 44 corresponds to calculation of surface impedance for the HZ-FSS. The parameters of the HZ-FSS include FSS cell size, FSS cell geometry, substrate thickness h, dielectric constant of the dielectric layer (real and imaginary parts), and the resistance of the FSS screen. Arrow 46, labeled GA, corresponds to the optimization of the HZ-FSS structure by a genetic algorithm. Other optimization processes can be used, as is discussed in more detail below. The resulting structure is shown at 48, corresponding to structure 10, having a FSS 50, dielectric substrate 52, and PEC backing layer 54.

Genetic algorithms are well known in the mathematical art, and will not be described in detail here. For example, the use of genetic algorithms is described in U.S. Pat. No. 5,719,794 to Altshuler et al. and U.S. Pat. Pub. No. 2003/0034918 to P. Werner et al. Due to the long convergence time required for a conventional GA, a micro-GA can be used to reduce the overall simulation time. Microgenetic algorithms are well known in the arts, and will not be described in more detail here.

Frequency Selective Surfaces

Figure 8:
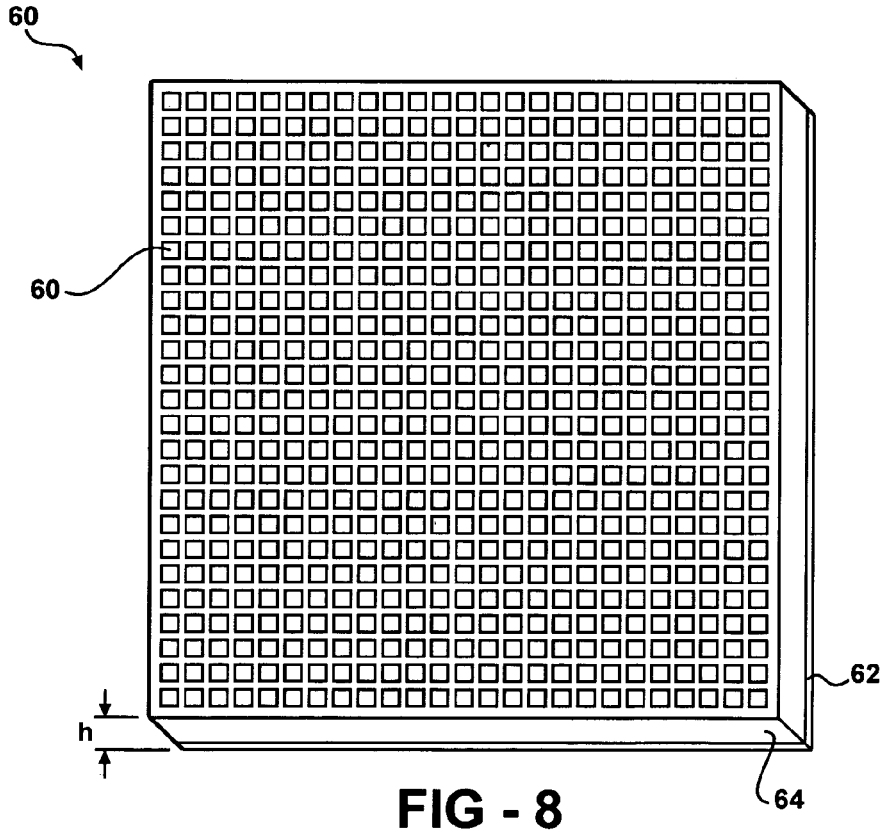
FIG. 8 shows the geometry of an HZ-FSS AMC including dielectric substrate and PEC backing.

FIG. 8 further illustrates a metamaterial ferrite design, having a metallic backing sheet (having the role of a perfect electrical conductor, PEC), a thin dielectric substrate of thickness h, and a frequency selective surface (FSS) supported by the dielectric substrate. The frequency selective surface (FSS) comprises a two-dimensional array of conducting elements, in this case an array of square electrical conductors. The surface impedance of this structure is selected to correspond to a desired permeability value.

A high impedance FSS (HZ-FSS) structure such as the structure of FIG. 8 has one or more resonance frequencies, where the surface resistance increases greatly within a narrow band, for example as shown in FIG. 3. In order to obtain a required permeability at a given operating frequency, the required permeability is related to a required surface impedance, using Equations 6 and 7 for example. Electromagnetic modeling of HZ-FSS structures is well known in the art, and obtaining a surface impedance in terms of the configuration of the HZ-FSS is routine. Hence, it is straightforward to design or to optimize (for example using a genetic algorithm) the HZ-FSS structure to obtain the required surface impedance.

For example, the structure of the FSS can be chosen to provide a resonance frequency close to the operating frequency. Here, the term close is in relation to the width of the resonance curves. For example, "close" may be within 2, 3, 5, 10, or 20 times the full width of half maximum of the surface resistance resonance curve. The resonance frequency can be selected to provide a real permeability having a magnitude greater than or equal to a certain required value, and an imaginary permeability less than a required value. In other applications, an imaginary permeability greater than or equal to a certain value may be required.

The structure of the FSS unit cell may be designed to provide multiple resonance frequencies, providing similar or different permeability properties at two or more operating frequencies.

The conductive elements may have different forms, such as fractal designs, periodic conductive shapes, periodic dielectric shapes within a conductor, structures similar to known photonic bandgap structures, three dimensional structures, and the like, or some combination thereof. For example, the FSS screen can comprise a two dimensional array of conducting elements, which may take the shape of geometric forms such as crosses, rings, squares, rectangles, other polygons, and the like. Geometric conducting forms may be solid (filled), or comprise a conducting periphery, and may comprise two or more concentric shapes, such as nested polygons or circles. Multilayer FSS configurations may also be employed.

A frequency selective surface can also comprise conducting posts, vias, or other elements having significant dimensions normal to the plane of the perfect electrical conductor.

The FSS can be printed or otherwise deposited onto the dielectric substrate. Alternatively, a conducting film can be etched so as to obtain the required form of conducting elements.

Calculation of FSS properties, such as surface impedance, can be determined using conventional software packages, such as supplied by Ansoft Corporation of Pittsburgh, Pa.

The perfect electrical conductor backing may be a metal sheet, such as copper, or other highly electrically conducting sheet, such as a conducting polymer.

In FIG. 8, the periodicity of conducting elements is the same in two orthogonal directions. However, the periodicity in different dimensions can be different, for example to obtain polarization or directional effects. Lattice structures having other symmetries can also be used, such as hexagonal arrays.

The dielectric film may be any suitable dielectric material, such as a dielectric known suitable for use in AMC structures. Dielectric materials are described in U.S. Pat. No. 6,597,318 to Parsche et al, and elsewhere. Dielectrics can include polymer materials, such as a polyester or polyimide, or an inorganic film, such as an oxide.

Electromagnetic Absorption

Thin magnetic films find many applications as electromagnetic absorbers. For example, the use of magnetic film radio wave absorbers is discussed in U.S. Pat. No. 6,670,546 to Okayama et al. Conventional ferrite films, as discussed earlier, do not work well above 1 GHz. Also, conventional ferrite films may need to be thick to absorb well, and so may be heavy.

Structures according to the present invention can be used to provide permeabilities equivalent to those desired for absorption layer applications. Hence, structures constructed according to the teachings of the present invention can be used in a number of absorption-related applications, such as reducing electromagnetic radiation reflection from vehicles (e.g., low radar reflectivity of aircraft), reducing electromagnetic interference, electromagnetic compatibility applications, shielding of electromagnetic radiation for health purposes, protecting electronic equipment from electromagnetic pulses, and the like.

Structures according to the present invention can be disposed on the surfaces of vehicles, the cabinets of electronic equipment (such as computers, microwave ovens, and other devices), within building materials (for example, for electronic security, or for health-related shielding of electromagnetic radiative devices), within microwave devices, and in conjunction with medical devices such as magnetic resonance imagers. Structures can also be fabricated using double-sided printed circuit board technology. Structures may also be flexible, for example formed from polymeric dielectrics, and polymer or flexible metal film conductors.

Double Negative Media

Left-handed or double negative media are currently the subject of intensive research. Such media have both a negative value of permittivity and a negative value of permeability, providing a negative refractive index. (The term left-handed media refers to the form of Snell's Law applicable to negative refractive index media).

There are various methods for obtaining negative permittivity known in the art. However, it has previously been a serious problem to obtain a material having negative real permeability. Methods described here facilitate the fabrication of structures with negative permeability, which may be combined with techniques to obtain negative permittivity so as to obtain a double negative material.

Negative real permeability and double negative metamaterials constructed according to the teachings of the present invention can be used in improved electromagnetic devices, for example antennas described in U.S. Pat. No. 6,661,392 to Isaacs et al.

Switchable Structures

Structures can be designed so as to have switchable properties. Properties may be switched between a first state and a second state, or may be continuously variable. For example, one state may correspond to a metaferrite, the other state to a standard AMC ground plane.

In one example, the first state corresponds to an absorbing state, and the second state corresponds to a non-absorbing state, for example, an efficient radiating state. Hence, a surface, such as the surface of an antenna, can be switched from a non-absorbing state to an absorbing state. Applications include communications, reducing radar cross-sections, and the like.

A vehicle can be provided with an antenna, such as a conformal antenna, having a surface which is in the non-absorbing state when the antenna is in use, and which is switched to an absorbing state when the antenna is not in use. Hence, the vehicle is able to maintain a reduced radar cross section when desired.

Switching between states can be achieved by one or more of several mechanisms. For example, electrically tunable circuit elements such as capacitors (or varactors) can be provided between conductive elements of the frequency selective surface. The dielectric layer between the FSS and the PEC backing may also be tunable, in whole or in part. The distance between the FSS and the PEC backing can be adjusted, for example if the dielectric material is air or other fluid, or deformable. The structure can be heated so as to induce expansion of one or more elements, or to modify the resistance of the FSS conducting elements. For example, a semiconductor can be used to provide the FSS material, allowing resistance control by thermal, electrical, or radiative (e.g. optical) mechanisms. The surface can be deformed into a curved surface, or otherwise modified.

Electronically tunable structures are described in U.S. Pat. Nos. 6,483,480, 6,538,621, and 6,552,696 to Sievenpiper et al, and described variable impedance arrangements can be adapted for use within a switchable absorber or other switched permeability device. Microelectromechanical devices and other switching devices can also be used.

Other Devices

Devices can be constructed including structures constructed according to methods described above, including antennas, reflectors, radiation absorbers, microwave devices generally, communications devices, and other electromagnetic devices. Structures according to the present invention can be used in place of ferrites in a number of device applications, for example in microwave devices such as resonators and circulators.

Examples given above are illustrative, and are not intended to be limiting. Other embodiments will be obvious to one skilled in the art.

Having described our invention, we claim:

1. A method of designing a metamaterial structure having a required permeability at a predetermined frequency, the metamaterial structure including a frequency selective surface located proximate to an electrically conductive layer, the method comprising:

relating the required permeability to a required surface impedance of the metamaterial structure at the predetermined frequency, the required permeability being equal to the required surface impedance divided by an intrinsic impedance of free space, a propagation constant of free space, and a thickness d of an equivalent electrical conductor backed magnetic film having the required permeability; and configuring the metamaterial structure so as to obtain the required surface impedance, the apparatus thereby having the required permeability.

2. The method of claim 1, wherein the required permeability includes a required real permeability denoted $\mu_r'$, the required surface impedance includes a required surface reactance denoted $X_{S1}$, the required real permeability being related to the required surface reactance using the equation $$\mu_r' = \frac{X_{S1}}{\eta_0 \beta_0 d},$$

where $\eta_0$ is the intrinsic impedance of free space, and $\beta_0$ is the propagation constant of free space.

3. The method of claim 1, wherein the required permeability includes a required imaginary permeability denoted $\mu_r''$, the required surface impedance includes a required surface resistance denoted $R_{S1}$, the required imaginary permeability being related to the required surface resistance by the equation $$\mu_r'' = \frac{R_{S1}}{\eta_0 \beta_0 d}$$

where $\eta_0$ is the intrinsic impedance of free space, and $\beta_0$ is the propagation constant of free space.

4. The method of claim 1, wherein configuring the metamaterial structure so as to obtain the required surface impedance includes selecting the frequency selective surface to have a resonance frequency proximate to the predetermined frequency.

5. The method of claim 1, wherein configuring the metamaterial structure so as to obtain the required surface impedance includes optimizing the frequency selective surface using an optimization algorithm.

6. The method of claim 5, wherein the optimization algorithm is a genetic algorithm.

7. The method of claim 1, wherein the frequency selective surface is disposed on a First side of the a dielectric substrate, and the electrically conductive layer is disposed on a second side of the dielectric substrate, the dielectric substrate having a dielectric thickness substantially less than the wavelength of electromagnetic radiation at the predetermined frequency.

8. An electromagnetic device including the metamaterial structure designed by the method of claim 1.

9. A method of designing a metamaterial structure having a permeability property of a ferrite film supported on a conducting ground plane, the metamaterial structure including a high impedance frequency selective surface, the method comprising:

specifying a required permeability of the metamaterial structure; and relating the required permeability of the metamaterial structure to a surface impedance of the metamaterial structure, the required permeability having a required real component of permeability denoted $\mu_r'$, the surface impedance having a surface reactance denoted $X_{S1}$, wherein $$\mu_r' = \frac{X_{S1}}{\eta_0 \beta_0 d},$$

where $\eta_0$ is the intrinsic impedance of free space, $\beta_0$ is the propagation constant of free space, and d is the thickness of the ferrite film, the value of surface reactance being chosen so as to provide the required real component of permeability.

10. The method of claim 9, wherein the required permeability further includes a required imaginary component $\mu_r''$, the required surface impedance having a surface resistance $R_{S1}$, wherein $$\mu_r'' = \frac{R_{S1}}{\eta_0 \beta_0 d}$$

the value of surface resistance being chosen so as to provide the imaginary component of permeability.

11. The method of claim 9, wherein the value of surface reactance is chosen using electromagnetic modeling of the metamaterial structure, the metamaterial structure being configured to provide the value of surface reactance.

12. The method of claim 11, wherein an optimization algorithm is used to configure the metamaterial structure so as to provide the value of surface reactance.

13. The method of claim 12, wherein the optimization algorithm is a genetic algorithm.

14. The method of claim 9, wherein the required real component of permeability is negative.

15. A structure providing a required permeability at an operating frequency, the structure comprising:

a dielectric substrate, having a first side and a second side, and having a dielectric thickness and a dielectric constant;

an electrically conducting layer disposed on the first side of the dielectric substrate; and a frequency selective surface disposed on the second side of the dielectric substrate, the structure having a surface impedance, wherein the surface impedance of the structure at the operating frequency is selected so as to provide the required permeability, the required permeability being equal to the surface impedance divided by an intrinsic impedance of free space, a propagation constant of free space, and a thickness d of an equivalent electrical conductor backed magnetic film having the required permeability.

16. The structure of claim 15, wherein the frequency selective surface includes a two-dimensional array of conducting elements.

17. The structure of claim 16, wherein the structure has the permeability properties of a ferrite film backed by a perfect electrical conductor, the operating frequency being greater than 1 GHz.

18. The structure of claim 15, wherein the structure is an electromagnetic absorber.

19. An antenna including the structure of claim 15.

20. A microwave device including the structure of claim 15.

* * * * *